United States Patent [19]

Skidmore

[11] 4,181,305

[45] Jan. 1, 1980

[54] APPARATUS FOR PLAYING A GAME

[76] Inventor: Michael Skidmore, 8, Carroways Pl., Margate, Kent, England

[21] Appl. No.: 877,943

[22] Filed: Feb. 15, 1978

[51] Int. Cl.[2] ..... A63F 9/08

[52] U.S. Cl. ..... 273/153 S; 46/1 A; 116/325

[58] Field of Search ..... 273/153 S, 281, 282; 46/1 A; 116/120, 136; 235/90

[56] References Cited

U.S. PATENT DOCUMENTS

| | | | |
|---|---|---|---|
| 299,608 | 6/1884 | Wilhelm | 116/136 UX |
| 626,863 | 6/1899 | Flack | 273/153 S |
| 1,101,567 | 6/1914 | Ridgway | 273/153 S |
| 1,421,656 | 7/1922 | Abell | 273/281 X |
| 2,197,976 | 4/1940 | Fletcher | 46/1 A |

FOREIGN PATENT DOCUMENTS

| | | | |
|---|---|---|---|
| 17634 | of 1902 | United Kingdom | 46/1 A |

*Primary Examiner*—Anton O. Oechsle

*Attorney, Agent, or Firm*—Oblon, Fisher, Spivak, McClelland & Maier

[57] ABSTRACT

The apparatus is made up of a board having four parellel columns of equal numbers of holes extending therethrough. A plurality of mutually distinguishable flexible pegs may be received in the holes. The pegs have indicium on both ends. The indicia on a given end of all of the pegs form a series, the indicium on one end of a given peg not corresponding in position in its series with the position of the indicium of the other end of the peg in its series. The number of pegs is less than the number of holes by at least the number of columns. The series are further divided into 4 subseries of equal numbers of pegs.

7 Claims, 5 Drawing Figures

APPARATUS FOR PLAYING A GAME

The present invention relates to a game of patience and provides apparatus for playing the game.

According to the present invention, there is provided apparatus for playing a game, said apparatus comprising a board having a plurality of substantially identical holes extending therethrough and a plurality of pegs fewer in number than said holes, each peg being adapted to be removably received in any of said holes and each peg having at one end thereof a respective indicium of a first series of indicia and at the other end thereof a respective indicium of a second series of indicia, whereby the pegs can be arranged in respective holes so that said first and second series of indicia can be viewed from respective sides of the board, and wherein at least some pegs have an indicium of the first series which does not correspond in position in the series to the indicium of the second series on the same peg.

In use, the pegs are inserted into respective holes in the board in random manner, or as otherwise determined by Rules of the game to be played, but with the ends relating to each series of indicia visible from the respective sides of the board. Pegs are moved from one hole to another in accordance with the Rules in an attempt to arrange the pegs so that the indicia of the first series are in a predetermined order. When no further movement of pegs in said attempt are permitted by the Rules, the board is viewed from the other side and the pegs then moved from one hole to another in an attempt to arrange the indicia of the second series in a predetermined order. When the Rules again permit no further movement of the pegs the play returns to the attempt to place the first series of indicia in order. The procedure is repeated until one of the series has been placed in order or no further moves are possible for either series. At all times the pegs are maintained in their original attitude so that all indicia are visible from the correct respective side of the board.

The game is intended to be played by one person but could be played by two persons if each were allocated a respective series of indicia.

Preferably, the board is flat and of a size which can be accomodated in a player's pocket, for example about 5 inches long by 3 inches wide by ¼ inch deep. Usually, but not necessarily, the holes in the board will be arranged in two or more parallel columns. In the presently most preferred embodiment, the board has four columns of from 10 to 14 (inclusive) holes in each column. The board can be made from any suitable material, for example wood or plastics.

It is preferred that each peg is resiliently flexible for engagement in any hole in the board. The holes and pegs usually will be of the same cross-sectional shape. For example, they can be of substantially rectangular (including square) or circular cross-section but other cross-sectional shapes can be used. The precise shape of the pegs will be determined inter alia by the cross-sectional shape of the holes in the board and it is preferred that the pegs are insertable into and removable from the holes from either side of the board. Each peg has at one end an indicium of a first series of indicia and at the other end an indicium of a second series of indicia. Usually, said indicia will be on the respective ends of the pegs. The indicia can comprise letters, number, symbols, colours or other indicating signs and advantageously will indicate the series to which a particular indicium belongs. For example, the indicia of the first and second series can be those of respective packs of ordinary playing cards. The first series can have a conventional white background whilst the second series can have a differently coloured background. Alternatively, the indicia of both series can be a combination of one or more letters with one or more numbers and different letters can be used in the respective series to distinguish between them.

Some at least, and preferably all, of the pegs have an indicium of the first series which does not correspond in position in said series with the indicium of the second series on the same peg. Thus, for example in the case of playing card indicia, a peg bearing the indicium of the king of hearts in one series would not also bear the indicium of the king of hearts in the other series.

Each series of indicia can be divided up into subseries such as, for example, suits of playing cards or letters, to facilitate variation, in accordance with Rules, of the predetermined order being sought from one game to the next. In the case of a board having columns of holes, the subseries advantageously consists of equal numbers of pegs with the number of subseries being equal to the number of columns.

There are fewer pegs than holes in the board to permit of unoccupied holes into which pegs may be moved from other holes. Usually, the pegs will occupy about 90% of the holes but in the case of a board having holes arranged in columns the number of unoccupied holes desirably should be at least equal to the number of columns.

The board can have peripheral walls upstanding from the respective sides thereof to protect the pegs against accidental dislodgement. Additionally or alternatively, a case is provided for the board, especially one in which the sides of the board can selectively be revealed for play.

The following is a description by way of example only and with reference to the accompanying drawings of apparatus in accordance with a preferred embodiment of this invention.

Figure 1:
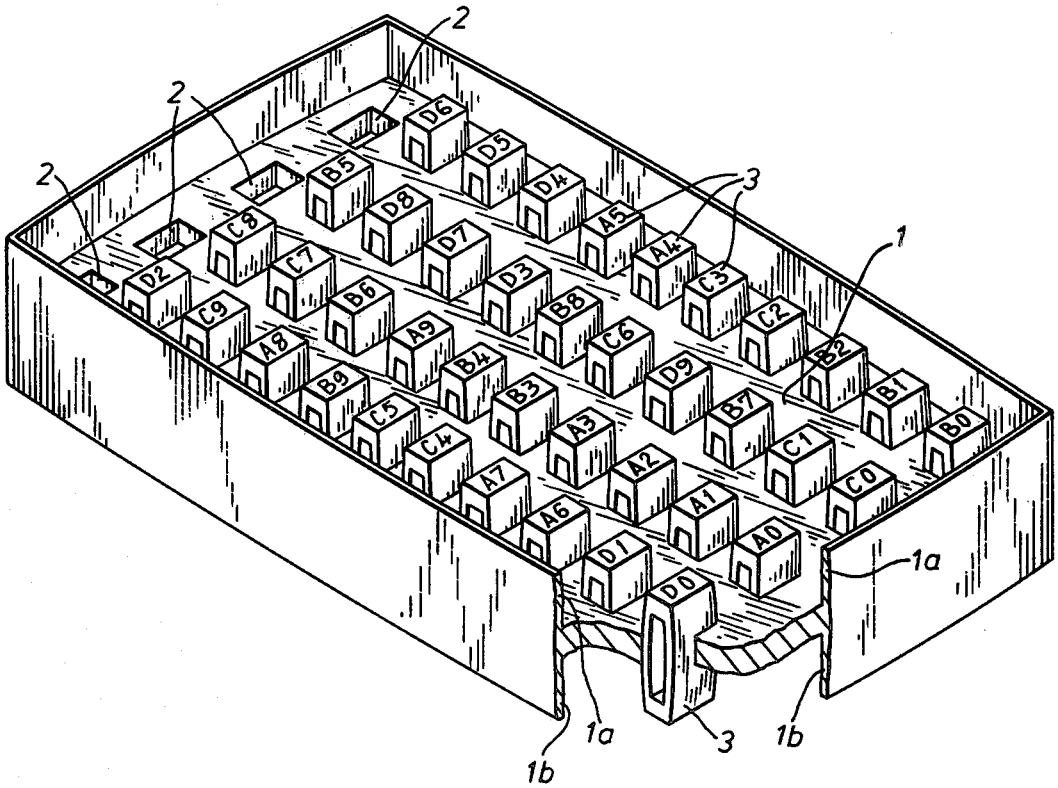
FIG. 1 is a perspective view of apparatus for playing a game.

Referring to the drawings, apparatus for playing a game comprises an oblong board 1 having peripheral walls 1*a*, 1*b* upstanding from the respective sides thereof. The board 1 has 44 identical holes 2 extending therethrough. The holes are arranged in four transversely spaced columns of 11 holes each and also in eleven longitudinally spaced rows of 4 holes each to provide the orthogonal array shown in the drawings. The apparatus includes also 40 resiliently flexible pegs 3 of identical dimensions and shape to constitute a fit in each of the holes 2. The pegs are hollow and have an opposite pair of mutually convex side walls to facilitate location in the holes 2. The pegs 3 are marked on one end thereof with respective indicia selected from a first series consisting of the four subseries A0 to A9, B0 to B9, C0 to C9 and D0 to D9 and on the other end thereof with respective indicia selected from a second series consisting of the four subseries W0 to W9, X0 to X9, Y0 to Y9 and Z0 to Z9. Thus, the respective pegs are marked as follows:

| one end | | other end | one end | | other end |
|---|---|---|---|---|---|
| A0 | - | W9 | B0 | - | Y4 |
| A1 | - | Z2 | B1 | - | X8 |
| A2 | - | X0 | B2 | - | W8 |
| A3 | - | W2 | B3 | - | X9 |
| A4 | - | Z4 | B4 | - | X1 |
| A5 | - | Y3 | B5 | - | W5 |
| A6 | - | X4 | B6 | - | W3 |
| A7 | - | X3 | B7 | - | X6 |
| A8 | - | Y9 | B8 | - | X7 |
| A9 | - | Z3 | B9 | - | W1 |
| C0 | - | W7 | D0 | - | Z2 |
| C1 | - | Y2 | D1 | - | W6 |
| C2 | - | Z9 | D2 | - | X5 |
| C3 | - | Y5 | D3 | - | Z1 |
| C4 | - | Y6 | D4 | - | W4 |
| C5 | - | W0 | D5 | - | Y3 |
| C6 | - | Y0 | D6 | - | Z8 |
| C7 | - | Z5 | D7 | - | Y7 |
| C8 | - | X2 | D8 | - | Z0 |
| C9 | - | Z6 | D9 | - | Y8 |

In use, the pegs 3 are placed in respective holes 2 in random order but excluding the lowermost row in the board and with the ends bearing indicia of the first series uppermost (see FIG. 1). The pegs marked A0, B0, C0 and D0 are removed from their initial positions and are placed in any order desired in the said lowermost row. The object of the game is to arrange the pegs so that they are in the column appropriate to the letter of the relevant indicium and in numerical order within that column. The constraints placed upon movement of the pegs are as follows:

1. Pegs in the lowermost row cannot be moved once play commences.

2. Pegs can only be moved into vacant holes and must be of the same letter and one number greater than the peg below the hole to which it is moved.

3. Pegs cannot be moved to a vacant hole above another vacant hole.

4. Pegs cannot be moved to a vacant hole above a peg with the number 9.

Figure 2:
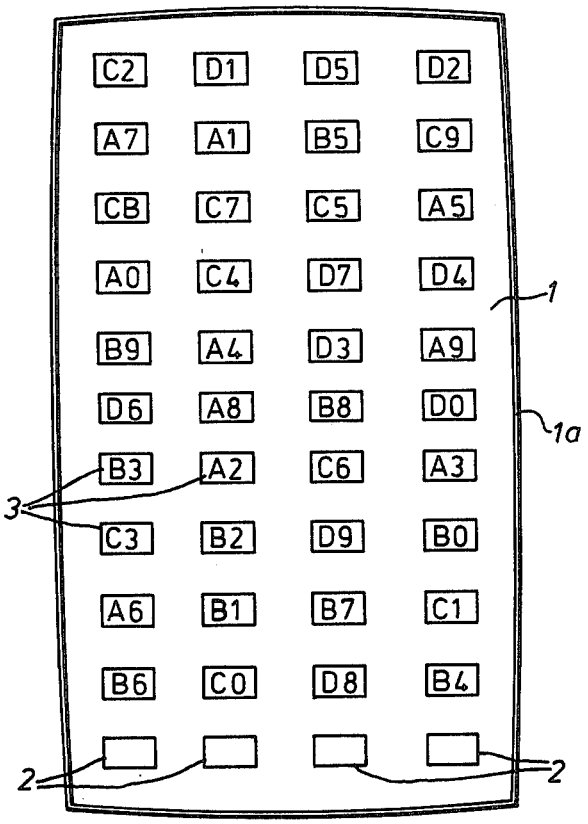
FIG. 2 is a plan view of a first side of the apparatus of FIG. 1 with pegs thereof in an initial pre-play arrangement.
Figure 3:
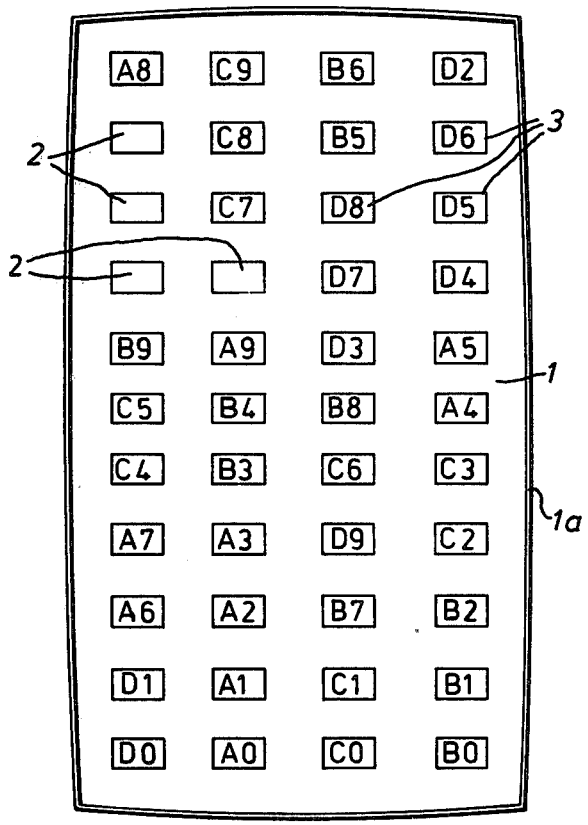
FIG. 3 is a view corresponding to FIG. 2 with the pegs in an arrangement where no further play is permitted on said first side.
Figure 4:
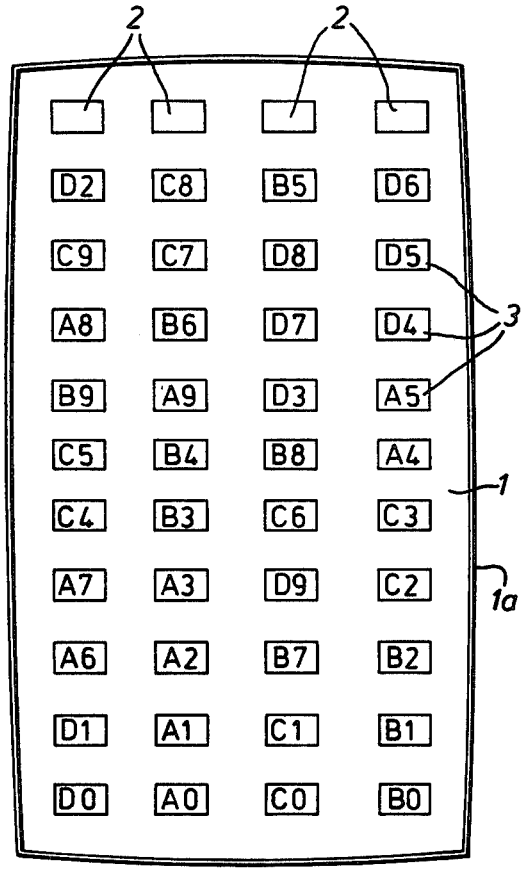
FIG. 4 is a view corresponding to FIG. 3 with the pegs rearranged for play to commence on the second side.
Figure 5:
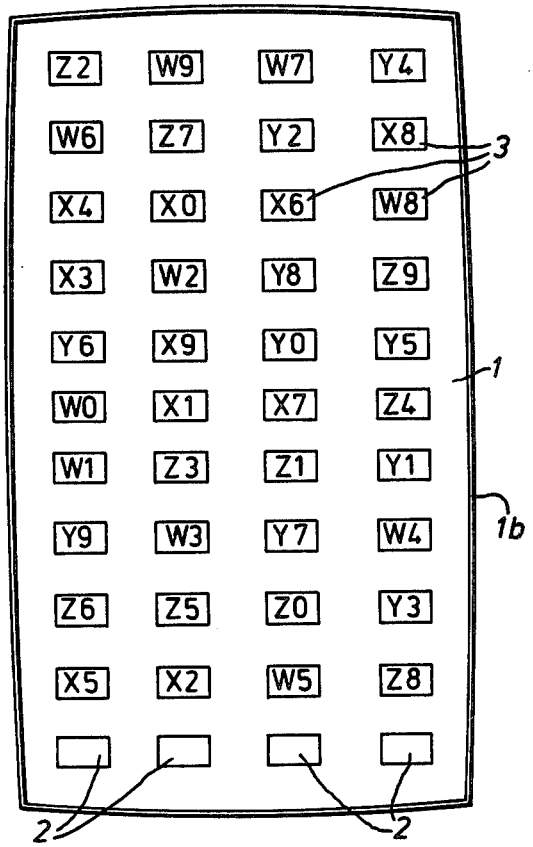
FIG. 5 is a plan view of the second side apparatus with the pegs in the same position as shown in FIG. 4 but after inversion of the apparatus.

When a stage of play has been reached where no further moves are possible (as shown in FIG. 2) any pegs in the uppermost row are moved into the vacant holes in the remainder of the board (as shown in FIG. 3). The board is then inverted (as shown in FIG. 4) and the game recommenced using the second side of the boards and the second series of indicia.

It will be appreciated that the invention is not restricted to the details particularly described above and that numerous modifications and variations can be made without departing from the scope of the invention as defined in the following claims.

What is claimed is:

1. Apparatus for playing a game, said apparatus comprising:

a board having a plurality of substantially identical holes extending therethrough and arranged in two or more parallel columns of equal numbers of holes, and a plurality of mutually distinguishable pegs each adapted to be removably received in any of said holes and each having at one end thereof a respective indicium of a first series of indicia and at the other end thereof a respective indicium of a second series of indicia, whereby the pegs can be arranged in respective holes so that said first and second series of indicia can be viewed from respective sides of the board and wherein the number of pegs is less than the number of holes by at least the number of columns and wherein at least some pegs have an indicium of the first series which does not correspond in position in said series to the indicium of the second series on the same peg;

and wherein each of the first and second series of indicia are divided into respective mutually distinguishable subseries of equal numbers of pegs, the number of subseries being equal to the number of columns.

2. The apparatus according to claim 1 wherein each peg is resiliently flexible for engagement in any hole in the board.

3. The apparatus according to claim 1 wherein the pegs are insertable into and removable from the said holes from either side of the board.

4. The apparatus according to claim 1 wherein the indicia of the first and second series are combinations of one or more letters with one or more numbers.

5. The apparatus according to claim 1 wherein the respective indicium of the first series on each peg does not correspond in position in the said series with the respective indicium of the second series on the same peg.

6. The apparatus according to claim 1 wherein the board has peripheral walls upstanding from the respective sides thereof to protect the pegs against accidental dislodgement.

7. The apparatus according to claim 4 wherein there are four parallel columns of from 10 to 14 holes.

* * * * *